US005715622A

United States Patent [19]

Giordano, Jr.

[11] Patent Number: 5,715,622

[45] Date of Patent: Feb. 10, 1998

[54] SHELF MOUNTED ELECTRONIC DISPLAY MODULES

[75] Inventor: Joseph J. Giordano, Jr., Somerset, N.J.

[73] Assignee: NCR Corporation, Dayton, Ohio

[21] Appl. No.: 753,162

[22] Filed: Nov. 21, 1996

Related U.S. Application Data

[63] Continuation of Ser. No. 319,210, Oct. 6, 1994, abandoned.

[51] Int. Cl.[6] ..... G09F 3/18

[52] U.S. Cl. ..... 40/661.03; 40/448; 40/666

[58] Field of Search ..... 40/5, 642, 666, 40/642.02, 661.03, 448; 248/222.11; 345/87; 340/825.35

[56] References Cited

U.S. PATENT DOCUMENTS

| | | | |
|---|---|---|---|
| 2,770,898 | 11/1956 | Lutz et al. | 40/5 X |
| 3,248,765 | 5/1966 | Achabal et al. | 248/222.11 |
| 4,002,886 | 1/1977 | Sundelin | 40/5 X |
| 4,500,880 | 2/1985 | Gomersall | 40/448 X |
| 4,924,363 | 5/1990 | Kornelson | 40/642 X |
| 5,111,196 | 5/1992 | Hunt . | |

FOREIGN PATENT DOCUMENTS

| | | | |
|---|---|---|---|
| 2083673 | 3/1982 | United Kingdom . | |
| 2249854 | 5/1992 | United Kingdom | 40/642 |
| 9319448 | 9/1993 | WIPO | 40/642 |

*Primary Examiner*—Brian K. Green
*Attorney, Agent, or Firm*—Craig E. Miller

[57] ABSTRACT

Shelf mounted electronic display modules which preferably include a first outwardly extending portion containing an electronic display and an antenna positioned outwardly from a shelf rail when mounted and a second rearwardly extending portion containing a printed wiring board and a battery power source positioned behind and protected by the shelf rail when mounted. The first outwardly extending portion and the second rearwardly extending portion are preferably connected below the shelf rail by a bight portion which mechanically and electronically connects the first outwardly extending portion and the second rearwardly extending portion together to form a substantially U-shaped configuration.

16 Claims, 4 Drawing Sheets

SHELF MOUNTED ELECTRONIC DISPLAY MODULES

This is a continuation of application Ser. No. 08/319,210 filed on Oct. 6, 1994, now abandoned.

BACKGROUND AND SUMMARY OF THE INVENTION

The present invention relates generally to new and novel improvements in shelf mounted electronic display modules. More particularly, the present invention relates to shelf mounted electronic display modules which, when mounted onto a shelf, extend outwardly a lesser distance from the shelf mounting surface than conventional shelf mounted electronic display modules.

Large retail stores often deal with several tens of thousands of different kinds of goods. In such stores, much attention is paid to the management and control of the inventory of goods and the displaying and labeling of the prices of goods being sold. Accordingly, much effort is expended and careful attention is paid to managing and controlling the stock of goods and to labeling the prices of goods displayed on shelves or in showcases. A mistake as to the labeling of the prices of goods could cause dissatisfaction to customers and damage the reputation of the store.

Therefore, it is desirable to identify the correct prices of goods and minimize the number of pricing errors. Accordingly, electronic display systems having multiple electronic display modules have been developed. Such electronic display systems are typically arranged such that light-weight compact electronic display modules which indicate the prices of goods are placed on display shelves or showcases. Such arrangements allow the prices indicated for the goods in the electronic display portions of the electronic display modules to be changed when the prices of goods are to be raised or lowered and/or when the arrangement of goods displayed on the display shelves or showcases is to be changed. In accordance with such electronic display systems, it becomes possible to reliably identify the correct prices of goods since changes in the prices of goods displayed on the electronic display portions of the electronic display modules are controlled and managed by a base communications station or some other control processing unit. If desired, other product information, for example, inventory or stocking information, product identification numbers or codes, and product volume or weight, could be displayed on the electronic display portions of the electronic display modules. In addition, electronic display systems in accordance with the present invention could be used in applications other than retail store environments, for example, in identifying inventory information in warehouses or distribution centers.

One problem which has been encountered in using electronic display modules in retail stores and similar environments is that they extend outwardly a significant distance from the shelf on which they are mounted and are susceptible to being damaged by impact from, for example, shopping carts or other objects. In addition, such outwardly extending electronic display modules can catch and potentially damage goods being removed from the shelf by customers or other individuals. Furthermore, such outwardly extending electronic display modules can catch the clothing of customers or other individuals, thus potentially tearing or damaging the clothing, or causing customers or other individuals to bump into the electronic display modules.

Accordingly, an object of the present invention is to provide shelf mounted electronic display modules which have a relatively low profile and are less susceptible to being damaged by impact from, for example, shopping carts and other objects, and reduce the risk of catching and/or damaging goods being removed from the shelf by customers or other individuals, as well as reduce the risk of catching the clothing of customers or individuals.

Another object of the present invention is the provision of shelf mounted electronic display modules which provide a reduced outwardly extending profile, while at the same time provide additional volume for a larger battery power supply, thus increasing the effective service life of the shelf mounted electronic display modules.

These and other objects of the present invention are attained by the provision of shelf mounted electronic display modules which preferably include a first outwardly extending portion containing an electronic display and an antenna positioned outwardly from a shelf rail when mounted and a second rearwardly extending portion containing a printed wiring board and a battery power source positioned behind and protected by the shelf rail when mounted. The first outwardly extending portion and the second rearwardly extending portion are connected below the shelf rail by a bight portion which mechanically and electronically connects the first outwardly extending portion and the second rearwardly extending portion together. In one preferred embodiment of the shelf mounted electronic display module in accordance with the present invention, the first outwardly extending portion, the second rearwardly extending portion and the bight portion are formed as a single integral unit. In a second preferred embodiment of the shelf mounted electronic display module in accordance with the present invention, the first outwardly extending portion and the bight portion are formed together as one part and the second rearwardly extending portion is formed as a second part. The first part and the second part are mechanically and electrically connected around the shelf rail to mount the two-piece electronic display module onto the shelf rail.

Other objects, advantages and novel features of the present invention will become apparent in the following detailed description of the invention when considered in conjunction with the accompanying drawings.

DETAILED DESCRIPTION OF THE DRAWINGS

Figure 1:
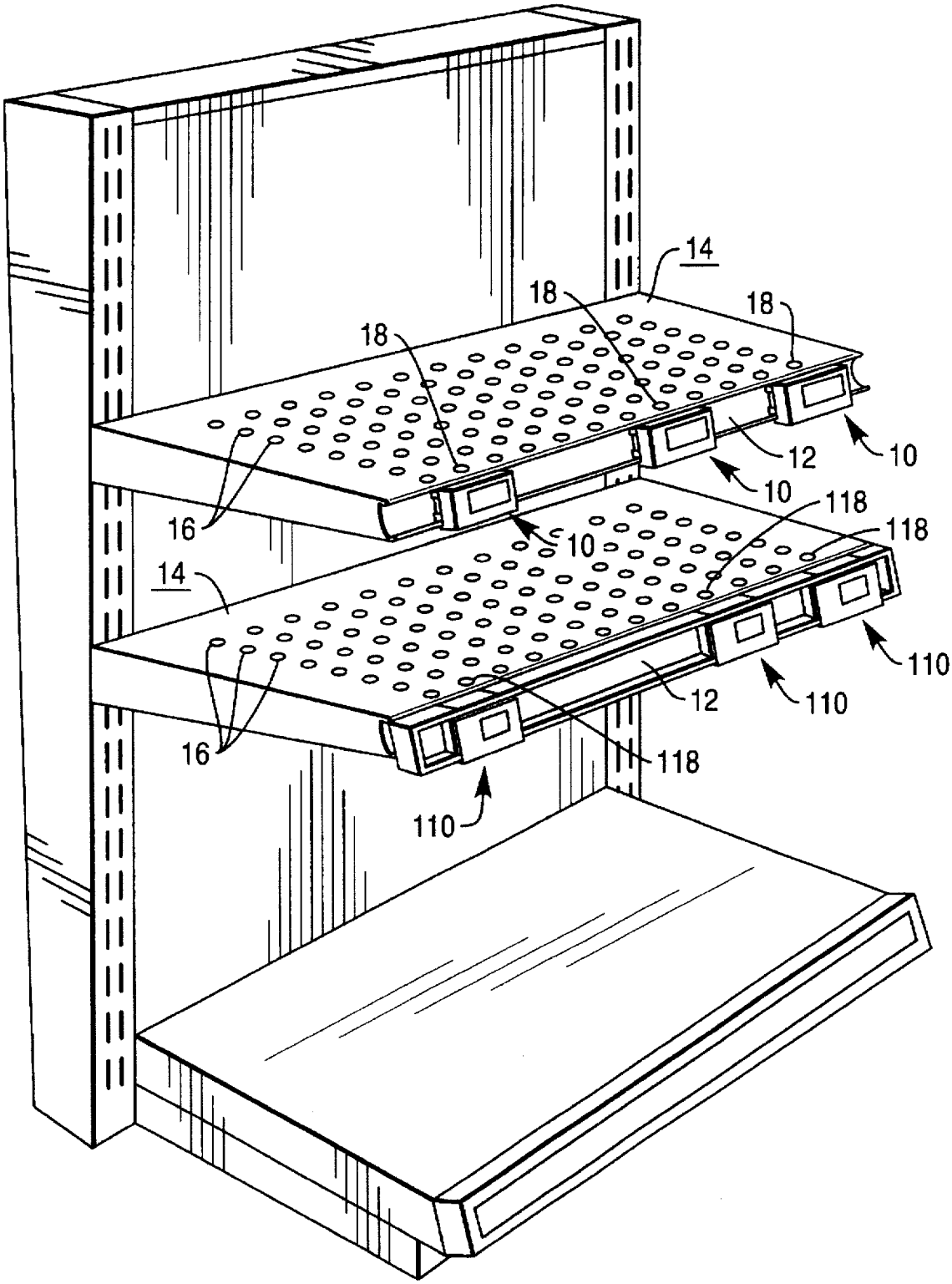
FIG.1 is a perspective view of a typical display showcase having multiple shelves and a plurality of shelf mounted electronic display modules in accordance with the present invention mounted thereon.

Referring now to the drawings, in which like-referenced characters indicate corresponding elements throughout the several views, attention is first directed to FIG. 1 which illustrates a first preferred embodiment and a second preferred embodiment of shelf mounted electronic display modules in accordance with the present invention, generally identified by reference numerals 10 and 110, respectively. In FIG. 1, a plurality of shelf mounted electronic display modules 10 and 110 are shown mounted onto shelf rails 12 of display shelves 14. Shelf rails 12 and display shelves 14 are preferably of conventional design.

Figure 2:
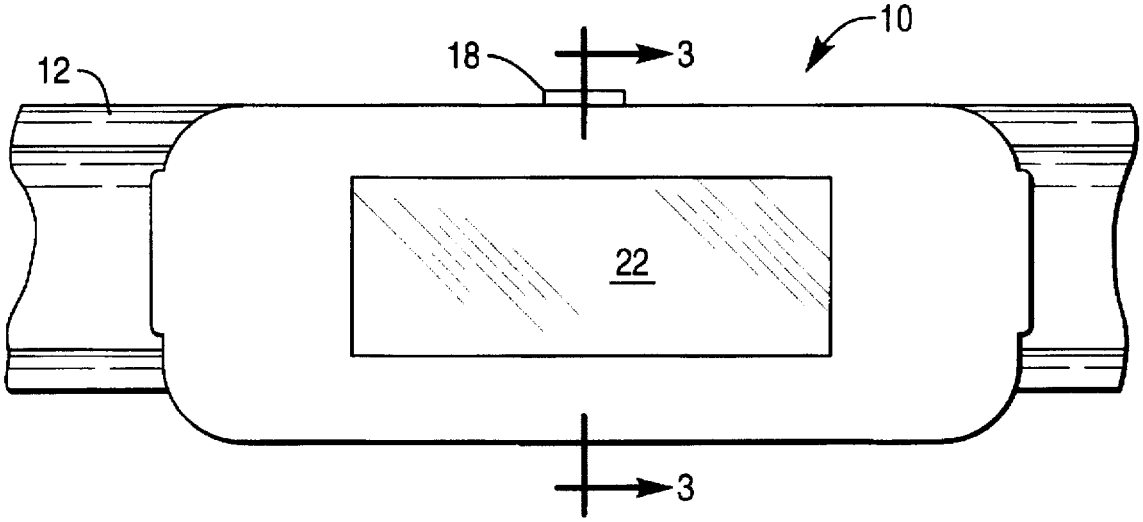
FIG. 2 is a front view of a first preferred embodiment of the shelf mounted electronic display module in accordance with the present invention as shown in FIG. 1 mounted onto a shelf rail of a display shelf.
Figure 3:
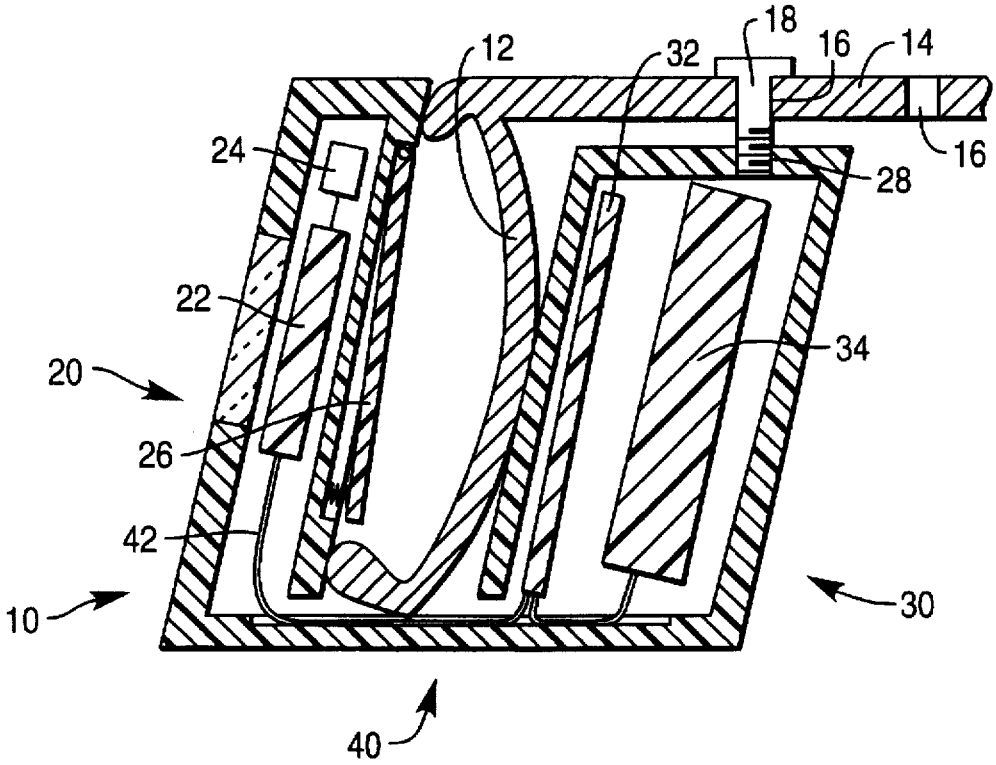
FIG. 3 is a cross-sectional side view of the first preferred embodiment of a shelf mounted electronic display module accordance with the present invention as shown in FIG. 1 mounted onto a shelf rail of a display shelf taken across line 3—3 in FIG. 2.

Referring now to FIGS. 2 and 3, a first preferred embodiment of shelf mounted electronic display module 10 in accordance with the present invention is shown. Shelf mounted electronic display module 10 generally includes first outwardly extending portion 20, second rearwardly extending portion 30 and bight portion 40 which mechanically and electrically connects first outwardly extending portion 20 and second rearwardly extending portion 30. When shelf mounted electronic display module 10 is mounted onto shelf rail 12 of display shelf 14, first outwardly extending portion 20 is positioned outwardly of shelf rail 12, second rearwardly extending portion 30 is positioned inwardly of and is partially covered by shelf rail 12 and bight portion 40 is positioned underneath shelf rail 12 and mechanically and electrically connects first outwardly extending portion 20 and second rearwardly extending portion 30.

In the first preferred embodiment of shelf mounted electronic display module 10 shown in FIGS. 2 and 3, first outwardly extending portion 20 houses electronic display 22, preferably a liquid crystal display (LCD), which displays information such as the displayed product's price, as well as other product information, such as the price per unit, the weight or size of the displayed product, the displayed product identification code number or other desired displayed product information, and antenna 24 which receives messages from, and transmits messages to a base communications station (not shown). It is desirable to position electronic display 22 outside of shelf rail 12 to facilitate the viewing of electronic display 22 by customers and other individuals. Similarly, it is desirable to position antenna 24 outside of shelf rail 12 to facilitate receipt of messages from, and transmittal of messages to base communications station (not shown).

Second rearwardly extending portion 30 preferably houses printed wiring board 32 which includes circuitry to control the operation of electronic display 22 and antenna 24 and battery power source 34 which provides electrical power for the operation of electronic display 22, antenna 24 and printed wiring board 32. It is desirable to position second rearwardly extending portion 30 inwardly from shelf rail 12 to minimize the extent first outwardly extending portion 20 projects outwardly from shelf rail 12. In addition, since second rearwardly extending portion 30 is positioned behind and is partially covered by shelf rail 12, the volume of second rearwardly extending portion 30 can be readily increased without increasing the extent of outward projection of electronic display module 10 from shelf rail 12, thus permitting a larger battery power source to provide extended service life of shelf mounted electronic display module 10 and/or to accommodate a larger printed circuit board to provide enhanced functionality.

Bight portion 40 extends from first outwardly extending portion 20 to second rearwardly extending portion 30 to provide mechanical and electrical connection between first outwardly extending portion 30 and second rearwardly extending portion 40. The first preferred embodiment of electronic display module is preferably fabricated as a single integral unit with first outwardly extending portion 20, second rearwardly extending portion 30 and bight portion 40 forming a substantially U-shaped configuration. The electrical connection between first outwardly extending portion 20 and second rearwardly extending portion is preferably provided by one or more electrically conductive wires, such as a substantially flat multi-wire electrical conductor, generally identified as reference numeral 42.

The back surface of first outwardly extending portion 20 preferably includes spring actuated or resiliently biased tapered snap portion 26 which is capable of being moved inwardly towards the front surface of first outwardly extending portion 20 to clear the bottom portion of shelf rail 12. When spring actuated or resiliently biased tapered snap portion 26 clears the bottom portion of shelf rail 12, spring actuated or resiliently biased tapered snap portion 26 moves outwardly away from the back surface of first outwardly extending portion 20 to retain shelf mounted electronic display module 10 on shelf rail 12.

Many display shelves 14 of conventional design include a plurality of apertures 16 to permit drainage and decrease the weight of the shelves. In many display shelves 14 of conventional design, apertures 16 are of a relatively uniform size, approximately ¼ inch in diameter, and are located inwardly a relatively uniform distance away from shelf rail 12, on the order of 1 inch inwardly away from shelf rail 12. In order to limit lateral movement of shelf mounted electronic display module 10 in relation to shelf rail 12, first outwardly extending portion 20 preferably includes aperture 28, most preferably a cylindrical internally threaded aperture, in its top surface. Aperture 28 is located such that when shelf mounted electronic display module 10 is mounted on shelf rail 12, aperture 28 in the top surface of first outwardly extending portion 20 is aligned with aperture 16 in display shelf 14. Positioning pin 18, preferably having an externally threaded portion corresponding to the internal threads in aperture 28, is inserted into aperture 28 and threadably engaged therein to limit the lateral movement of shelf mounted electronic display module 10 in relation to display shelf 14.

Figure 4:
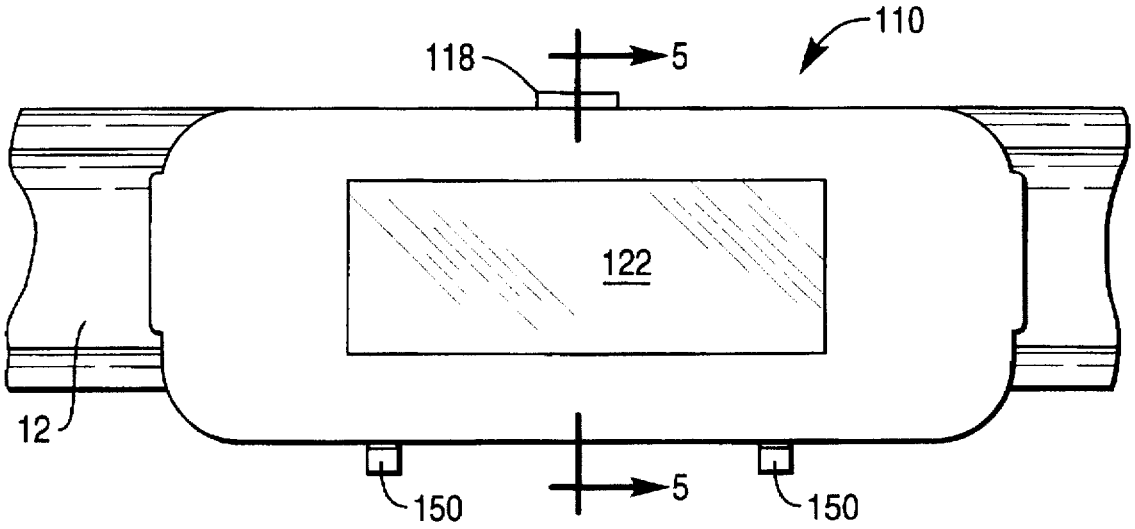
FIG. 4 is a front view of a second preferred embodiment of the shelf mounted electronic display module in accordance with the present invention as shown in FIG. 1 mounted onto a shelf rail of a display shelf.
Figure 5:
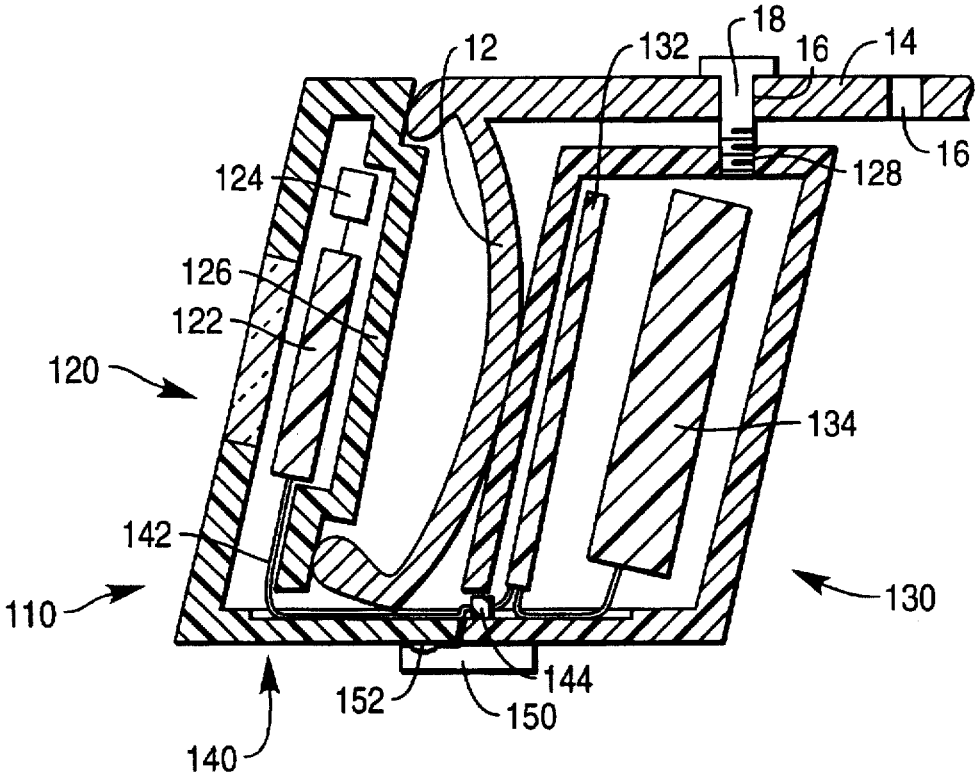
FIG.5 is a cross-sectional side view of the second preferred embodiment of a shelf mounted electronic display module in accordance with the present invention as shown in FIG. 1 mounted onto a shelf rail of a display shelf taken across line 5—5 in FIG. 4.
Figure 6:
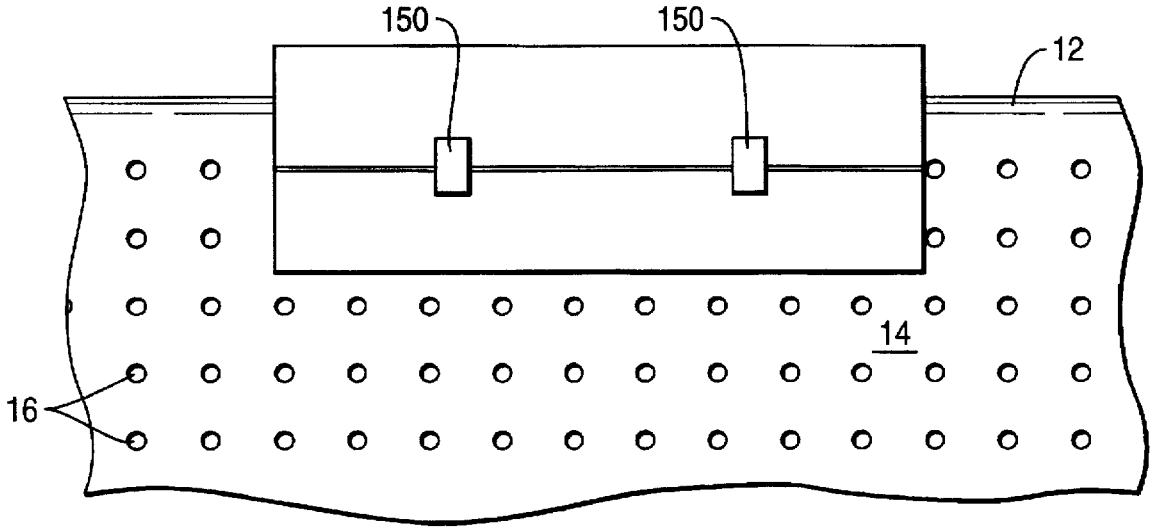
FIG. 6 is a bottom view of the second preferred embodiment of a shelf mounted electronic display module in accordance with the present invention as shown in FIG. 1 mounted onto a shelf rail of a display shelf.

Referring now to FIGS. 4 through 6, a second preferred embodiment of a shelf mounted electronic display module in accordance with the present invention, generally identified by reference numeral 110, is shown. Shelf mounted electronic display module 110 is preferably assembled from a first part including first outwardly extending portion 120 and bight portion 140 and a second part including second rearwardly extending portion 130. As in the first preferred embodiment of shelf mounted electronic display module 10 shown in FIGS. 2 and 3, first outwardly extending portion 120 houses electronic display 122, preferably a liquid crystal display (LCD), which displays information such as the displayed product's price, as well as other product information, such as the price per unit, the weight or size of the displayed product, the displayed product identification code number or other desired displayed product information, and antenna 124 which receives messages from, and transmits messages to a base communications station (not shown). It is desirable to position electronic display 122 outside of shelf rail 12 to facilitate the viewing of electronic display 122 by customers and other individuals. Similarly, it is desirable to position antenna 124 outside of shelf rail 12 to facilitate receipt of messages from, and transmittal of messages to base communications station (not shown).

Second rearwardly extending portion 130 preferably houses printed wiring board 132 which includes circuitry to control the operation of electronic display 122 and antenna 124 and battery power source 134 which provides electrical power for the operation of electronic display 122, antenna 124 and printed wiring board 132. It is desirable to position second rearwardly extending portion 130 inwardly from shelf rail 12 to minimize the extent first outwardly extending portion 120 projects outwardly from shelf rail 12. In addition, since second rearwardly extending portion 130 is positioned behind and is partially covered by shelf rail 12, the volume of second rearwardly extending portion 130 can be readily increased without increasing the extent of outward projection of shelf mounted electronic display module 110 from shelf rail 12, thus permitting a larger battery power source to provide extended service life of shelf mounted electronic display module 110 and/or to accommodate a larger printed circuit board to provide enhanced functionality.

Bight portion 140 extends from first outwardly extending portion 120 to second rearwardly extending portion 130 to provide mechanical and electrical connection between first outwardly extending portion 120 and second rearwardly extending portion 130. The mechanical connection between bight portion 140 and second rearwardly extending portion 130 is preferably accomplished by one or more resiliently biased tabs 150 on either of bight portion 140 or second rearwardly extending portion 130. Resiliently biased tabs 150 ramp over and snap in position over projections 152 formed in the other of bight portion 140 and second rearwardly extending portion 130. As shown in FIGS. 4 through 6, resiliently biased tabs 150 are formed on the bottom surface of second rearwardly extending portion 130 and projections 152 are formed on the bottom surface of bight portion 140. However it should be recognized that the position of resiliently biased tabs 150 and projections 152 could be reversed. The electrical connection between first outwardly extending portion 120 and second rearwardly extending portion 130 is preferably provided by one or more electrically conductive wires, such as a substantially flat multi-wire electrical conductor, generally identified as reference numeral 142, and a pin and socket connector, generally identified as reference numeral 144, positioned between second rearwardly extending portion 130 and bight portion 140.

The back surface of first outwardly extending portion 120 preferably includes an outwardly extending portion 126 which is capable of being positioned inside shelf rail 12 when shelf mounted electronic display module 110 is mounted on shelf rail 12.

Many display shelves 14 of conventional design include a plurality of apertures 16 to permit drainage and decrease the weight of the shelves. In many display shelves 14 of conventional design, apertures 16 are of a relatively uniform size, approximately ¼ inch in diameter, and are located a relatively uniform distance inwardly away from shelf rail 12, on the order of 1 inch inwardly away from shelf rail 12. In order to limit lateral movement of shelf mounted electronic display module 110 in relation to shelf rail 12, first outwardly extending portion 120 preferably includes aperture 128, most preferably a cylindrical internally threaded aperture, in its top surface. Aperture 128 is located such that when shelf mounted electronic display module 110 is mounted on shelf rail 12, aperture 128 in the top surface of first outwardly extending portion 120 aligns with aperture 16 in display shelf 14. Positioning pin 18, preferably having an externally threaded portion corresponding to the internal threads in aperture 128, is inserted into aperture 128 and is threadably engaged therein to limit the lateral movement of shelf mounted electronic display module 110 along shelf rail 12.

To mount shelf mounted electronic display module 10 on shelf rail 12, shelf mounted electronic display module 10 is moved upwardly with first outwardly extending portion 20 outward of shelf rail 12 and second rearwardly extending portion 30 inward of shelf rail 12, thus pushing spring actuated or resiliently biased tapered snap portion 26 over the bottom lip of shelf rail 12 so spring actuated or resiliently biased tapered snap portion 26 locks shelf mounted electronic display module 10 in position on shelf rail 12. Aperture 28 in second rearwardly extending portion 30 is then aligned with aperture 16 in display shelf 14 and positioning pin 18 is threadably engaged through aperture 16 into aperture 28 in second rearwardly extending portion 30 to limit lateral movement of shelf mounted electronic display module 10 along shelf rail 12.

Conversely, to remove shelf mounted electronic display module 10 from shelf rail 12, positioning pin 18 is removed from aperture 28 in second rearwardly extending portion 30. Spring actuated or resiliently biased tapered snap portion 26 is then held against the back surface of first outwardly extending portion 20 and shelf mounted electronic display module 10 is moved downwardly to remove shelf mounted electronic display module 10 from shelf rail 12.

To mount shelf mounted electronic display module 110 on shelf rail 12, the first part containing first outwardly extending portion 120 and bight portion 140 is held in position against the front surface of shelf rail 12. Then, the second part containing second rearwardly extending portion 130 is positioned behind shelf rail 12, and is moved outwardly towards the back surface of shelf rail 12 to engage pin and socket connector 144 and position resiliently biased tabs 150 over projections 152. Aperture 128 in second rearwardly extending portion 130 is then aligned with aperture 16 in display shelf 14 and positioning pin 18 is threadably engaged through aperture 16 into aperture 128 in second rearwardly extending portion 130 to limit lateral movement of shelf mounted electronic display module 110 along shelf rail 12.

Conversely, to remove shelf mounted electronic display module 110 from shelf rail 12, positioning pin 18 is removed from aperture 128 in second rearwardly extending portion 130. Then, with resiliently biased tabs 150 held away from projections 152, the second part containing second rearwardly extending portion 130 is moved inwardly away from the back surface of shelf rail 12 disconnecting pin and socket connector 144. This separates shelf mounted electronic display module 110 into two parts, the first part containing first outwardly extending portion 120 and bight portion 140 and the second part containing second rearwardly extending portion 130.

Although the present invention has been described above in detail, such explanation is by way of example only, and is not to be taken as a limitation on the present invention. For example, shelf mounted electronic display modules in accordance with the present invention may be used in various environments outside of retail stores, for example, in warehouses or distribution centers. Accordingly, the scope and content of the present invention are to be limited and defined only by the terms of the appended claims.

What is claimed is:

1. An electronic display module mounted on a shelf rail, said electronic display module comprising:

a first outwardly extending portion having an electronic display mounted in front of an outward side of the shelf rail, said first portion having a back surface including a spring actuated or resiliently biased tapered snap portion fitting inside the shelf rail;

a second rearwardly extending portion having a power source mounted behind the shelf rail; and a connecting bight portion joining said first outwardly extending portion and said second rearwardly extending portion to form a substantially U-shaped configuration, said bight portion having an electrical conductor to conduct electrical power from said power source to said electronic display.

2. The electronic display module in accordance with claim 1, wherein said electronic display is a liquid crystal display (LCD).

3. The electronic display module in accordance with claim 1, wherein said first outwardly extending portion includes an antenna for receiving wireless communication from a base communications station.

4. The electronic display module in accordance with claim 1, wherein said first outwardly extending portion includes an antenna for receiving wireless communication from a base communications station and transmitting wireless communication to said base communications station.

5. The electronic display module in accordance with claim 4, wherein said second rearwardly extending portion includes a printed circuit board to control said electronic display and said antenna.

6. The electronic display module in accordance with claim 1, wherein said second rearwardly extending portion includes a printed circuit board to control said electronic display.

7. The electronic display module in accordance with claim 1, wherein said first outwardly extending portion, said second rearwardly extending portion and said bight portion are formed as a single integral unit.

8. An electronic display module mounted on a shelf rail, said electronic display module comprising:

a first outwardly extending portion positioned outwardly of the shelf rail, said first outwardly extending portion having an electronic display and said first outwardly extending portion having a back surface including a spring actuated or resiliently biased tapered snap portion fitting inside the shelf rail;

a second rearwardly extending portion positioned inwardly of the shelf rail, said second rearwardly extending portion having a power source; and a connecting portion for mechanically and electrically connecting said first outwardly extending portion and said second rearwardly extending portion.

9. The electronic display module in accordance with claim 8, wherein said electronic display is a liquid crystal display (LCD).

10. The electronic display module in accordance with claim 8, wherein said first outwardly extending portion includes an antenna for receiving wireless communication from a base communications station.

11. The electronic display module in accordance with claim 8, wherein said first outwardly extending portion includes an antenna for receiving wireless communication from a base communications station and transmitting wireless communication to said base communications station.

12. The electronic display module in accordance with claim 11, wherein said second rearwardly extending portion includes a printed circuit board to control said electronic display and said antenna.

13. The electronic display module in accordance with claim 8, wherein said second rearwardly extending portion includes a printed circuit board to control said electronic display.

14. The electronic display module in accordance with claim 8, wherein said first outwardly extending portion, said second rearwardly extending portion and said connecting portion are formed as a single integral unit.

15. A method of mounting an electronic display module on a shelf rail, comprising the steps of:

positioning said electronic display module below the shelf rail with a first outwardly extending portion outside of the shelf rail and a second rearwardly extending portion inside of the shelf rail;

moving said electronic display module upwardly to position said first outwardly extending portion outside of the shelf rail and said second rearwardly extending portion inside of the shelf rail; and engaging a spring actuated or resiliently biased tapered snap portion on a back surface of said first outwardly extending portion with the shelf rail.

16. The method of mounting an electronic display module on a shelf rail in accordance with claim 15, further including the step of engaging a positioning pin in an aperture in said second rearwardly extending portion to limit lateral movement of said electronic display module along the shelf rail following the step of engaging a spring actuated or resiliently biased tapered snap portion on the back surface of said first outwardly extending portion with the shelf rail.

* * * * *